United States Patent [19]

Lamon

[11] 4,367,859

[45] Jan. 11, 1983

[54] CEILING-MOUNTED HOLDER FOR INTRAVENOUS FLUID RECEPTACLES

[75] Inventor: David M. Lamon, Columbus, Ohio

[73] Assignee: The Horton Company, Columbus, Ohio

[21] Appl. No.: 167,940

[22] Filed: Jul. 14, 1980

[51] Int. Cl.[3] ..... A47H 1/10

[52] U.S. Cl. ..... 248/318; 248/293

[58] Field of Search ..... 248/318, 293, 324, 291, 248/311.3; 211/116

[56] References Cited

U.S. PATENT DOCUMENTS

| | | | |
|---|---|---|---|
| 1,289,830 | 12/1918 | Leimecke | 248/293 X |
| 1,888,142 | 11/1932 | Pearson | 248/293 |
| 1,890,577 | 12/1932 | Flake | 248/293 |
| 2,716,531 | 8/1955 | Johnson | 248/293 X |
| 3,709,372 | 1/1973 | Alexander | 248/318 X |
| 4,044,983 | 8/1977 | Francis | 248/311.3 X |

FOREIGN PATENT DOCUMENTS

| | | | |
|---|---|---|---|
| 1118416 | 11/1961 | Fed. Rep. of Germany | 248/293 |

*Primary Examiner*—J. Franklin Foss

*Attorney, Agent, or Firm*—William S. Rambo

[57] ABSTRACT

An I.V. fluid receptacle holder for attachment to the ceiling of an ambulance, or the like, features a receptacle-stabilizing arm that is pivotally connected to a shallow, ceiling-mounted, supporting frame for swinging movement between a generally horizontal position flush with the ceiling, and a vertically dependent position of use, and which is locked by spring pressed means in both positions.

3 Claims, 5 Drawing Figures

CEILING-MOUNTED HOLDER FOR INTRAVENOUS FLUID RECEPTACLES

BACKGROUND OF THE INVENTION

The present invention relates generally to hangers or article-supporting brackets and more particularly to an improved hanger bracket for attachment to the inner roof surface or ceiling of an ambulance and used to support bags or receptacles containing intravenous (I.V.) fluids.

The administration of I.V. solutions to ill or injured persons being transported to a hospital in an ambulance is common practice. Today many types of I.V. fluids are supplied in flexible plastic bags which must be suspended above the patient in some manner. In the past, these I.V. fluid bags were often supported on hooks provided on the walls or ceiling of the emergency vehicle, or hung from elongated poles extending upwardly from the cot or stretcher upon which the patient was placed, or simply held by hand.

The problem with these early suspension methods was their tendency to create an obstruction which hindered intransit medical attention, and to permit the I.V. solution container to sway violently as the ambulance sped to the hospital. Excessive movement of the container caused fluid flow interruptions and subjected the tubes and needle which fed the fluid from the container to the victim to unwanted stress.

The most pertinent prior art known to applicant is U.S. Pat. No. 4,044,983 issued Aug. 30, 1977 to Francis. This patent discloses a holder provided with a receptacle-supporting, retractable hanger which is secured to a flat-surfaced prism resiliently clamped against a ceiling-mounted bracket by a spring plate. There are, however, certain drawbacks to the Francis device. For instance, the full weight of the I.V. fluid bag is carried by the retractable hanger. It may be possible, therefore, for the hanger to be wrenched out of its position of use by the torque exerted by the mass of the receptacle as the ambulance rapidly changes direction or speed. Furthermore, the Francis holder requires a hole or recess in the ambulance ceiling to accomodate the spring plate and fastening bolts.

SUMMARY AND OBJECTS OF THE INVENTION

The present ceiling-mounted holder for I.V. fluid receptacles comprises a supporting frame provided with hook means from which the receptacle is supported and with an L-shaped detent-forming guide slot that opens at one end of the frame; a receptacle-stabilizing arm pivotally attached to the frame to swing through the guide slot between "up" and "down" positions; frame-mounted spring means to bias the stabilizing arm into engagement with the locking detent when the arm occupies either its "up" or "down" positions; and manually operated lever means to disengage the arm from the detent.

The primary object of the present invention is to provide an improved I.V. fluid container holder for emergency vehicles that may be folded quickly against the ceiling when not in use and that, in its vertical position, provides greater stability for the I.V. container than heretofore possible.

Another aim of the present invention is to provide an improved ceiling-mounted holder having a safe, reliable locking mechanism to secure the stabilizing arm in its vertical and horizontal positions.

These and other objects and advantages of the present invention are more readily apparent with reference to the following description and drawings.

DESCRIPTION OF THE PREFERRED EMBODIMENT

Figure 5:
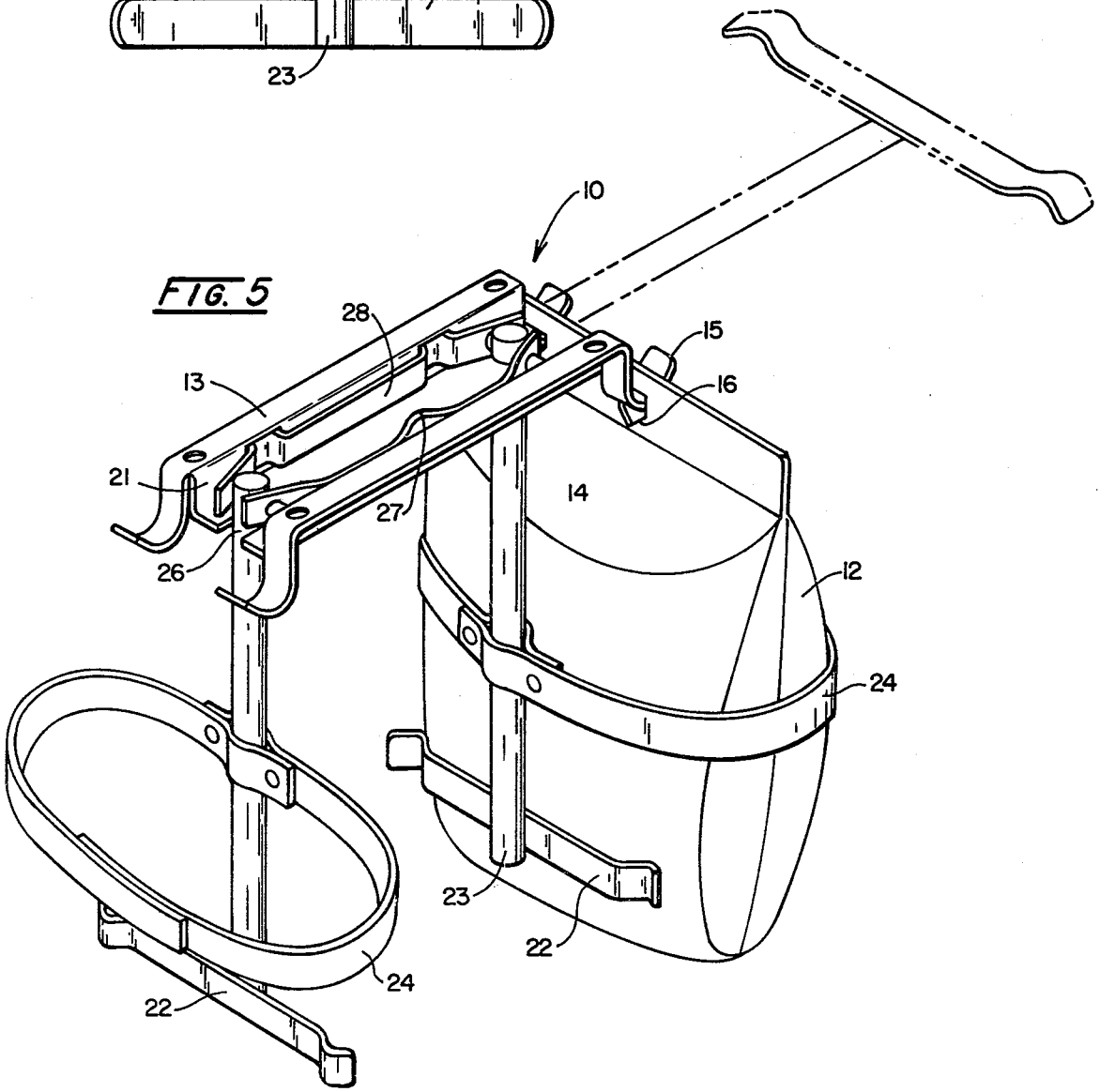
FIG. 5 is a perspective view of the hanger with an I.V. fluid-containing bag supported thereon.

As indicated in the drawings, the present holder or hanger, generally designated 10, is rigidly attached to a ceiling or interior roof area 11 (FIG. 1) in an ambulance or other emergency vehicle (not shown), and is designed to provide a substantially motion-free rack and brace for an intravenous (I.V.) fluid container or receptacle 12 (FIG. 5). The invention basically comprises a shallow, box-like supporting frame 13 to which at least one longitudinally extended, receptacle-stabilizing arm 14 is pivotally attached. Preferably, the supporting frame 13 is longitudinally extended and includes a pair of substantially identical stabilizing arms 14, pivotally attached at opposite ends of the frame 13. For clarity, however, only one of the arms 14 and its associated frame-mounted structures will be described. The supporting frame 13 and stabilizing arm 14 are preferably fabricated from stainless steel, although other metals or synthetic resins would also suffice.

The supporting frame 13, is formed into a box-like shape in order to provide working space for various structures within the confines of the frame 13 and thereby to eliminate the need for a recess or concavity in the ambulance ceiling 11 to accommodate such structures. In addition, the frame 13 is formed with hook means 15 (FIG. 5) to which the I.V. fluid container 12 is attached by slots or holes 16 formed in the upper portion of the container. In this manner, most of the weight of the container 12 is carried or supported by the frame 13, instead of by the arm 14.

Figure 2:
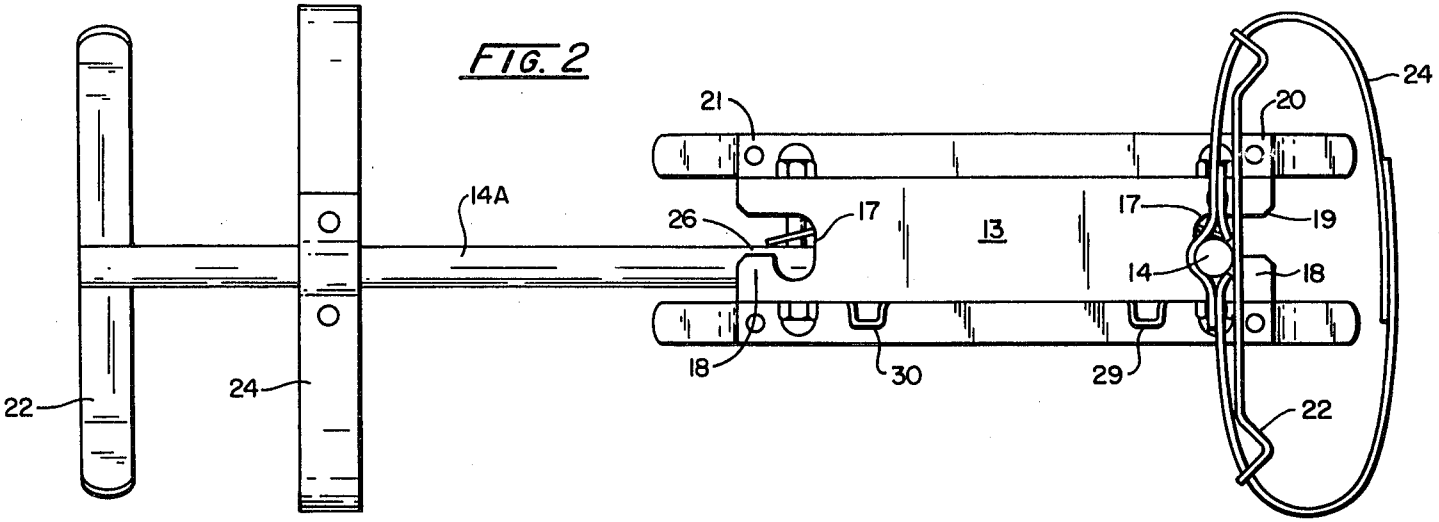
FIG. 2 is a bottom plan view of the hanger only.

As best illustrated in FIG. 2, the frame 13 is also provided with at least one L-shaped guide slot 17 that defines an arm-locking detent 18 and that forms an opening 19 at one end 20 of the frame 13. The guide slot 17, as may be readily understood, is associated with the operation of the stabilizing arm 14; thus, in the preferred form of the invention, there are a pair of substantially identical slots 17, one for each arm 14, at opposite ends 20 and 21, respectively, of the frame 13. As with the arms 14, however, only one of the guide slots will be referred to in detail.

Figure 1:
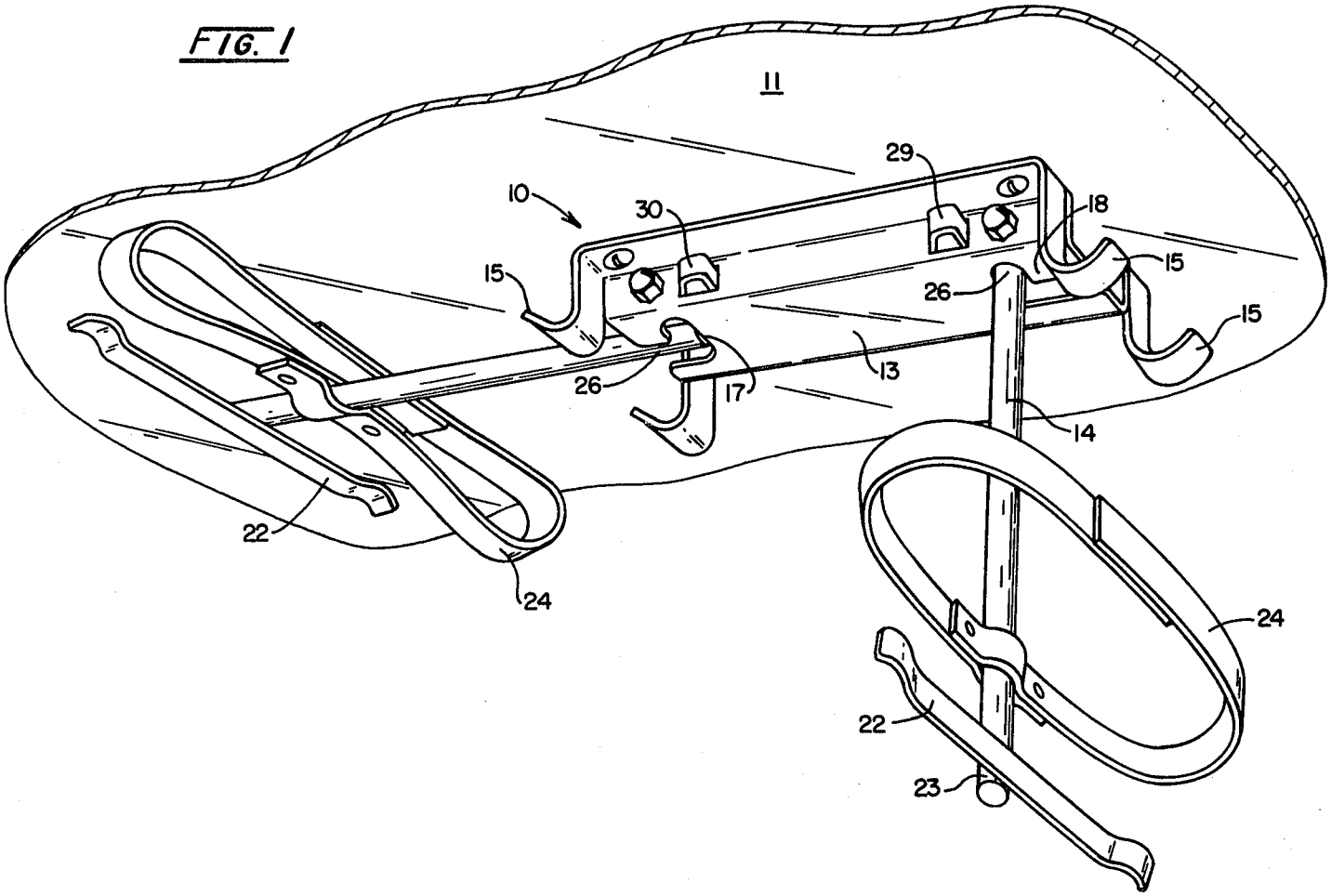
FIG. 1 is a perspective view looking upwardly and illustrating the present holder installed in the ceiling of an ambulance and showing one of its stabilizing arms in its "up" position and its other arm in its "down" position.

The receptacle-stabilizing arm 14, as illustrated in FIGS. 1 and 5, is a longitudinally extended shaft that projects outwardly from the frame 13 and preferably includes a winglike stabilizing bracket 22 attached at the free end portion 23 of the arm 14, and flexible banding means 24, such as a Velcro strap, that wraps around the I.V. fluid receptacle 12. In this manner, the container 12 may be held substantially motionless against the stabilizing arm as the emergency vehicle speeds to its destination. The arm 14, as indicated by the drawings, is designed to be secured in either a generally horizontally disposed, "up" position closely adjacent to the ceiling 11, or in a generally vertically disposed, "down" position depending from the ceiling 11. As may be readily understood, the arm 14 in its horizontal position minimizes the hazard and obstruction imposed by the holder upon the attendant or patient; whereas in its vertical position, the arm 14 (and frame 13) are ready to receive the I.V. fluid container 12.

Figure 3:
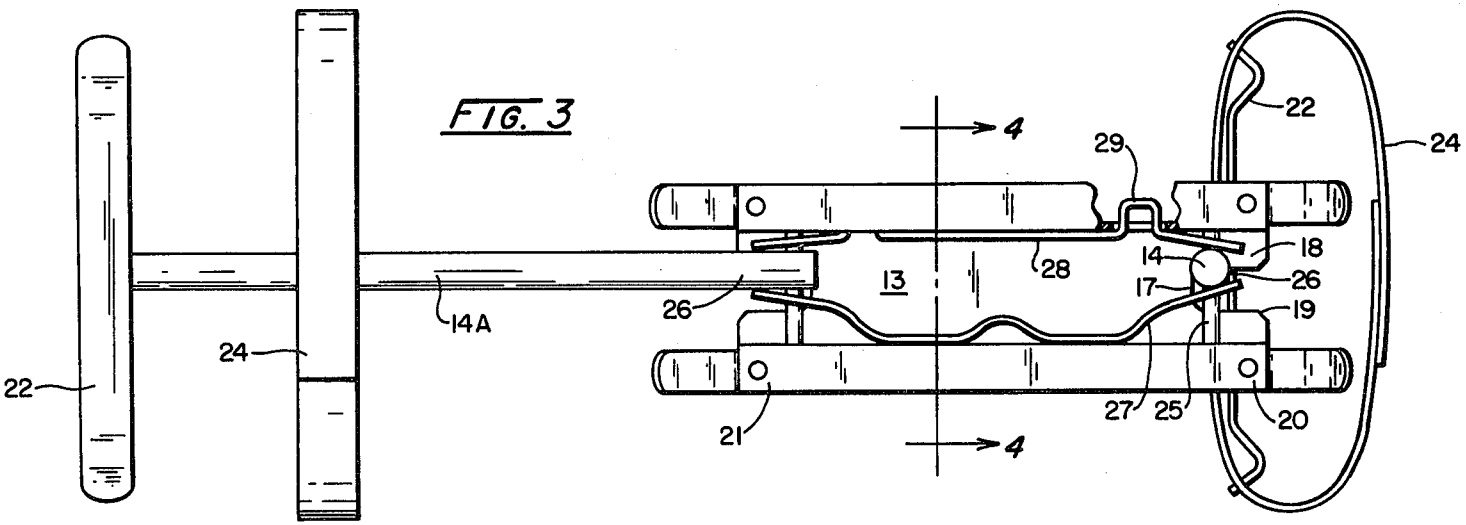
FIG. 3 is a top plan view thereof.
Figure 4:
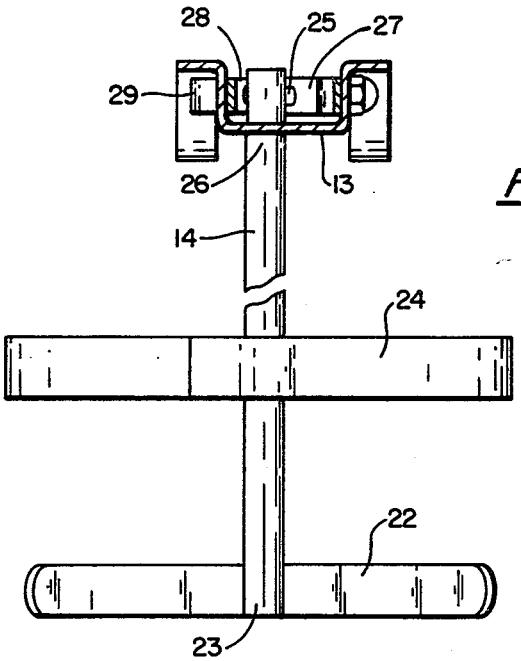
FIG. 4 is a transverse vertical sectional view, taken along line 4—4 of FIG. 3.

As indicated in FIG. 3, the stabilizing arm 14 is pivotally attached to the frame 13 by mounting means 25, preferably a trunnion-like pin that extends through the arm 14 and attaches at its opposite ends to the supporting frame 13. The pin 25 is upwardly adjacent to the associated guide slot 17 and is transversely oriented with respect to the long axis of the frame 13. Mounted in the frame 13 by the trunnion pin 25 or other, equivalent mounting means, the arm 14 is capable of both swinging movement in a generally vertical plane and limited sliding movement in a generally transverse or lateral direction relative to the vertical swinging plane.

As may be readily understood, the swinging movement permitted by the mounting means 25 allows the arm 14 to move quickly between its "up" and "down" positions. In the course of this swinging movement, an intermediate portion 26 of the arm 14 moves within the guide slot 17, unobstructed by the locking detent 18. As the arm swings toward its horizontal, "up" position, the intermediate portion 26 of the arm passes out of the opening 19 in the guide slot 17. As the arm swings towards its vertical, "down" position, the intermediate portion 26 of the arm moves into the interior of the guide slot.

The lateral sliding movement allowed by the mounting means 25 permits the intermediate portion 26 of the arm 14 to be shifted into engagement with the locking detent 18 when the arm occupies either "up" or "down" positions. Spring means, such as a leaf or bow spring 27 mounted within the frame 13, resiliently biases the supporting arm 14 to shift in this manner. As the swinging movement brings the arm into its "down" position, the intermediate arm portion 26 moves past the detent 18 and into the interior of the guide slot 17, and the spring 27 simultaneously urges the arm to shift laterally toward the closed end of the guide slot. Accordingly, the intermediate portion 26 of the arm moves behind, and into engagement with, the detent 18. As may be readily understood, the arm cannot swing out of its "down" position as long as its intermediate portion engages the detent.

As the swinging movement brings the arm into its "up" position, the intermediate arm portion moves past the detent and out of the guide slot opening 19, and the spring means 27 simultaneously urges the arm to shift laterally toward the detent. Accordingly, the intermediate portion of the arm moves in front of the detent and into engagement with the upper surface thereof, as best indicated by the arm 14A at the opposite end 21 of the frame 13 in FIGS. 2 and 3. Once again, the arm cannot swing out of its "up" position as long as the intermediate arm portion engages the detent.

Manually operable lever means 28 and therefore provided to release the stabilizing arm from its "up" and "down" locked positions for swinging movement therebetween. The lever 28 preferably includes at least one release node 29 (FIGS. 1 and 3) extending outwardly from the frame which may be pushed inwardly by the attendant to disengage the intermediate portion of the arm from either the rear or upper portions of the locking detent. As may be readily understood, the attendant is, in effect, supplying a counterforce which overcomes the spring-induced bias that holds the arm in either its generally horizontal or vertical detent-engaging positions. Preferably, the lever means 28 comprises a longitudinally extended bar having two outwardly-projecting release nodes 29 and 30, as indicated in FIG. 1. Each release node 29 and 30 disengages the stabilizing arm adjacent thereto.

To operate the ceiling-mounted holder for I.V. receptacles whose stabilizing arm or arms are in horizontally disposed, "up" positions closely adjacent to the ambulance ceiling, the attendant momentarily presses the release node adjacent to the stabilizing arm he or she wishes to use. The arm will swing into the vertically disposed, "down" position by the force of its own weight and will automatically shift into locking engagement with the detent, owing to the spring-induced, lateral bias. The attendant may then attach the top portion of the I.V. container to the hooks on the supporting frame and fasten the banding means 24 around the body of the container, so that the container is securely held against the wing bracket 22. The I.V. fluid receptacle will then be held substantially motionless, despite the movement of the ambulance. After the container is removed from the holder, the attendant depresses the release node momentarily and, at the same time, swings the stabilizing arm upwardly into its horizontal position adjacent to the ceiling. The arm will automatically shift into locking engagement with the detent and will remain in its "up" position while the ambulance travels along until the holder is needed again.

While a single preferred embodiment of the present I.V. solution container holder has been disclosed in some detail, the foregoing description and the accompanying drawings are not intended to unnecessarily limit the invention nor unduly restrict the scope of the following claims.

I claim:

1. A ceiling-mounted holder for intravenous (I.V.) fluid receptacles, said holder comprising:

(a) a relatively shallow, box-like supporting frame for rigid attachment to a ceiling and including:
  (i) hook means for supporting an I.V. receptacle, and
  (ii) a generally L-shaped guide slot opening at one end of said frame and defining thereon an arm-locking detent;

(b) a receptacle-stabilizing arm pivotally connected to said frame for swinging movement between an "up" position substantially flush with the ceiling and a "down" position depending from the ceiling; a portion of said arm being movable within the guide slot of said frame as said arm swings between its "up" and "down" positions;

(c) spring means carried by said frame and arranged normally to bias said arm laterally into engagement with the locking detent of said frame when said arm occupies either its "up" or "down" positions to thereby hold said arm against swinging movement; and (d) manually operable lever means carried by said frame and operable to disengage said arm from said detent and thereby free said arm for swinging movement.

2. A ceiling-mounted holder defined in claim 1, wherein said receptacle-stabilizing arm has one end portion thereof pivotally connected to said supporting frame and a free end portion extending outwardly from said frame and provided with a stabilizing bracket and a flexible, receptacle banding means.

3. A ceiling-mounted holder defined in claim 1, wherein said supporting frame is provided with two guide slots opening respectively at opposite ends of said frame, and wherein a receptacle-stabilizing arm is pivotally attached to said frame adjacent to each of said slots.

* * * * *